US009627191B2

(12) United States Patent
Johnson et al.

(10) Patent No.: US 9,627,191 B2
(45) **Date of Patent: *Apr. 18, 2017**

(54) EXTENDABLE MULTI-TOOL INCLUDING INTERCHANGABLE LIGHT BULB CHANGER AND ACCESSORIES

(71) Applicant: WAGIC, INC., San Jose, CA (US)

(72) Inventors: Ronald L. Johnson, San Jose, CA (US); Robert J. Gallegos, Fremont, CA (US); Idriss Mansouri-Chafik Ruiz, San Jose, CA (US)

(73) Assignee: WAGIC, INC., Los Gatos, CA (US)

( * ) Notice: Subject to any disclaimer, the term of this patent is extended or adjusted under 35 U.S.C. 154(b) by 304 days.

This patent is subject to a terminal disclaimer.

(21) Appl. No.: 14/464,555

(22) Filed: Aug. 20, 2014

(65) Prior Publication Data

US 2014/0352993 A1 Dec. 4, 2014

Related U.S. Application Data

(63) Continuation of application No. 13/945,642, filed on Jul. 18, 2013, now Pat. No. 8,844,407, which is a (Continued)

(51) Int. Cl.
*H01K 3/32* (2006.01)
*B25B 23/00* (2006.01)

(Continued)

(52) U.S. Cl.
CPC ..... *H01K 3/32* (2013.01); *A47L 13/38* (2013.01); *B25B 11/007* (2013.01); *B25B 13/48* (2013.01);

(Continued)

(58) Field of Classification Search
CPC .... H01K 3/32; B25B 23/005; B25B 23/1425; B25B 23/147; B25B 11/007; B25B 13/48; A47L 13/38; Y10T 29/49826
See application file for complete search history.

(56) References Cited

U.S. PATENT DOCUMENTS 548,537 A 10/1895 Green
558,573 A 4/1896 Smith (Continued)

FOREIGN PATENT DOCUMENTS

CA 2495991 2/2004
CN 90226503.2 U 3/1992

(Continued)

*Primary Examiner* — David B Thomas
(74) *Attorney, Agent, or Firm* — Haverstock & Owens LLP

(57) ABSTRACT

An extendable multi-tool comprising an extendable pole and a head unit selectively detachably coupled together. The head unit comprises a grasping mechanism configured to engage a light bulb, a control switch and a rotation mechanism. The control switch configured to cause the grasping mechanism to become secured to a light bulb, and to cause the rotation mechanism to automatically detect when a light bulb is secured to the grasping mechanism and then rotate the grasping unit and the secured light bulb in a first direction based on the position of the control switch. The tool further comprises an arm unit for positioning the grasping mechanism in a desired configuration to engage the light bulb, wherein the arm member is coupled to the grasping mechanism.

19 Claims, 13 Drawing Sheets

Related U.S. Application Data continuation of application No. 12/882,066, filed on Sep. 14, 2010, now Pat. No. 8,516,925.

(60) Provisional application No. 61/243,448, filed on Sep. 17, 2009.

(51) Int. Cl.

| | |
|---|---|
| ***B25B 23/147*** | (2006.01) |
| ***A47L 13/38*** | (2006.01) |
| ***B25B 11/00*** | (2006.01) |
| ***B25B 13/48*** | (2006.01) |
| ***B25B 23/142*** | (2006.01) |

(52) U.S. Cl.

CPC ..... *B25B 23/005* (2013.01); *B25B 23/147* (2013.01); *B25B 23/1425* (2013.01); *Y10T 29/49826* (2015.01)

(56) References Cited

U.S. PATENT DOCUMENTS 578,394 A 3/1897 Dunn et al.
609,421 A 8/1898 Edwards
623,180 A 4/1899 Rhine
634,419 A 10/1899 Welden
636,229 A 10/1899 Sims
659,631 A 10/1900 Croteau et al.
673,191 A 4/1901 Arthur
675,640 A 6/1901 Renard
750,408 A 1/1904 Speelman
801,902 A 10/1905 Olafson
809,985 A 1/1906 Rundberg
869,836 A 10/1907 Gaynor
895,625 A 8/1908 Gaynor
925,084 A 6/1909 Edgerton
927,908 A 7/1909 Webb
977,158 A 11/1910 Berkstresser
987,562 A 3/1911 Ferguson
1,056,084 A 3/1913 Bates
1,133,613 A 3/1915 Buss et al.
1,171,380 A 2/1916 Arthur
1,193,685 A 8/1916 Harvey
1,201,506 A 10/1916 Rozelle et al.
1,202,432 A 10/1916 Rozelle et al.
1,210,835 A 1/1917 Price
1,223,791 A 4/1917 Jackson
1,258,430 A 3/1918 Morris
1,311,776 A 7/1919 Rodriguez
1,449,358 A 3/1923 Weber
1,488,031 A 3/1924 Bridwood
1,514,814 A 11/1924 Allen
1,540,143 A 6/1925 Pierpoint
1,541,839 A 6/1925 Metzler et al.
1,655,979 A 1/1928 Watkins
1,787,670 A 1/1931 Clarkson
1,823,170 A 9/1931 Schulz
1,847,953 A 3/1932 Finsley
2,117,017 A 5/1938 Chadsey
2,157,563 A 5/1939 Pethick
2,243,106 A 5/1941 Limbed
2,357,104 A 8/1944 Grinnell
2,357,105 A 8/1944 Grinnell
2,387,846 A 10/1945 Hayes
2,473,008 A 6/1949 Chadsey
2,545,043 A 6/1951 Odenthal
2,556,701 A 6/1951 Mendoza
2,573,002 A 10/1951 Foster
2,607,620 A 8/1952 Oliveri
2,616,743 A 11/1952 Negley
2,634,998 A 4/1953 Flower
2,637,587 A 5/1953 Robinson
2,669,478 A 2/1954 Bowie
2,701,052 A 2/1955 Martel
2,722,448 A 11/1955 Popp et al.
2,946,615 A 7/1960 Yawman, Jr. et al.
2,983,541 A 5/1961 Maki
3,101,966 A 8/1963 Thomas et al.
3,549,188 A 12/1970 Cerasoli
3,631,738 A 1/1972 Harper
3,666,311 A 5/1972 McMullin
3,696,694 A 10/1972 Boro
3,731,966 A 5/1973 Nagy
3,776,584 A 12/1973 Van Gerven
3,788,691 A 1/1974 McMullin
3,799,599 A 3/1974 Jordan
4,068,878 A 1/1978 Wilner
4,167,354 A 9/1979 Walker
4,190,839 A 2/1980 Liautaud
4,218,085 A 8/1980 Unger
4,385,849 A 5/1983 Crain
4,611,512 A 9/1986 Honda
4,663,996 A 5/1987 Grudgfield et al.
4,711,353 A 12/1987 Rozmestor
4,719,826 A 1/1988 DuBois
4,730,960 A 3/1988 Lewis et al.
D297,499 S 9/1988 Whitney
4,791,835 A 12/1988 Unger et al.
4,819,800 A 4/1989 Wilson
4,844,171 A 7/1989 Russell et al.
4,852,925 A 8/1989 Lodin
4,864,899 A 9/1989 Morse
4,876,929 A 10/1989 Kozak
4,901,606 A 2/1990 Christensen
4,970,921 A 11/1990 Fagan
5,103,695 A 4/1992 Dolle et al.
5,123,311 A 6/1992 Dymek
5,148,723 A 9/1992 Newman, Sr. et al.
5,218,889 A 6/1993 Brockberg
5,317,939 A 6/1994 Marinescu
5,330,243 A 7/1994 Held
5,379,666 A 1/1995 Held
5,385,420 A 1/1995 Newman, Sr. et al.
5,386,744 A 2/1995 Garcia
5,407,293 A 4/1995 Crainich
5,436,526 A 7/1995 Hohaus et al.
5,458,026 A 10/1995 Southard et al.
5,464,407 A 11/1995 McGuire
5,490,438 A 2/1996 Zupo et al.
5,546,291 A 8/1996 Simes
5,553,373 A 9/1996 Sprayberry
5,564,852 A 10/1996 Maxwell et al.
5,566,596 A 10/1996 Lin
5,572,913 A 11/1996 Nasiell
5,593,196 A 1/1997 Baum et al.
5,609,079 A 3/1997 Hashimoto
5,647,622 A 7/1997 Schectman
5,649,255 A 7/1997 Schieltz
5,692,417 A 12/1997 Irpino
5,697,269 A 12/1997 Tseng
5,730,033 A 3/1998 Mitrowski
5,752,287 A 5/1998 Wheat
5,765,453 A 6/1998 Mims
5,797,918 A 8/1998 McGuire et al.
5,802,692 A 9/1998 Philippe
5,806,903 A 9/1998 George
5,809,850 A 9/1998 Tickner
5,816,401 A 10/1998 Vasudeva et al.
5,823,073 A 10/1998 Tickner
5,823,700 A 10/1998 Poworoznek
5,855,274 A 1/1999 Piao
5,918,741 A 7/1999 Vasudeva
5,941,139 A 8/1999 Vodehnal
6,000,251 A 12/1999 Murray, Jr. et al.
6,032,796 A 3/2000 Hopper et al.
6,105,767 A 8/2000 Vasudeva
6,131,740 A 10/2000 Huang
6,223,628 B1 5/2001 Barron
6,254,303 B1 7/2001 Falat et al.
6,332,381 B1 12/2001 Vasudeva
6,371,290 B1 4/2002 Yearous
6,401,923 B1 6/2002 Huang
6,453,777 B1 9/2002 Newman et al.
6,553,872 B1 4/2003 Tse et al.

(56) References Cited

U.S. PATENT DOCUMENTS

| | | | | |
|---|---|---|---|---|
| 6,709,196 | B1 | 3/2004 | Medendorp | |
| 6,739,220 | B1 | 5/2004 | Johnson et al. | |
| 6,826,983 | B1 | 12/2004 | Magdi | |
| 6,827,210 | B2 | 12/2004 | Chen | |
| 6,863,471 | B2 | 3/2005 | Medendorp | |
| 6,883,400 | B2 | 4/2005 | Sugano | |
| 6,941,841 | B2 | 9/2005 | Johnson et al. | |
| 7,131,352 | B1 | 11/2006 | Saunders | |
| 7,143,668 | B2 | 12/2006 | Johnson et al. | |
| 7,147,399 | B2 | 12/2006 | Viscount et al. | |
| 7,255,024 | B2 | 8/2007 | Johnson et al. | |
| 7,305,908 | B2 | 12/2007 | Chi | |
| 7,334,503 | B1 | 2/2008 | Newman | |
| 7,631,579 | B2 | 12/2009 | Johnson et al. | |
| 7,743,683 | B2 | 6/2010 | Dayton et al. | |
| 7,856,907 | B2 | 12/2010 | Johnson et al. | |
| 8,104,380 | B2 | 1/2012 | Johnson et al. | |
| 8,448,546 | B2 | 5/2013 | Johnson et al. | |
| 8,516,925 | B2 * | 8/2013 | Johnson | A47L 13/38 81/472 |
| 8,844,407 | B2 * | 9/2014 | Johnson | A47L 13/38 81/472 |
| 2003/0136234 | A1 | 7/2003 | Cunningham | |
| 2003/0226428 | A1 | 12/2003 | Liu | |
| 2004/0025641 | A1 | 2/2004 | Sugano | |
| 2005/0011318 | A1 | 1/2005 | Tsai | |
| 2005/0178246 | A1 | 8/2005 | Johnson et al. | |
| 2005/0247587 | A1 | 11/2005 | Holland-Letz | |
| 2006/0101955 | A1 | 5/2006 | Chang | |
| 2007/0062831 | A1 | 3/2007 | Chen | |
| 2007/0125202 | A1 | 6/2007 | Johnson et al. | |
| 2007/0295171 | A1 | 12/2007 | Johnson | |
| 2008/0104780 | A1 | 5/2008 | Dayton et al. | |
| 2008/0173138 | A1 | 7/2008 | Dayton et al. | |
| 2008/0189870 | A1 | 8/2008 | Dayton et al. | |
| 2010/0258465 | A1 | 10/2010 | Gomas | |
| 2010/0288520 | A1 | 11/2010 | Dayton et al. | |
| 2011/0094910 | A1 | 4/2011 | Fleury et al. | |
| 2013/0228484 | A1 | 9/2013 | Yang | |

FOREIGN PATENT DOCUMENTS

| | | | |
|---|---|---|---|
| DE | DD217665 | A1 | 1/1985 |
| DE | 20 2007 003841 | U1 | 9/2007 |
| GB | 2198383 | A | 6/1988 |
| GB | 2362125 | A | 11/2001 |
| JP | 52-90382 | | 7/1977 |
| JP | 5527001 | A | 2/1980 |
| JP | 61033371 | A | 2/1986 |
| JP | 61-62355 | | 4/1986 |
| JP | 62175655 | | 11/1987 |
| JP | 63024617 | | 2/1988 |
| JP | 64-35658 | | 3/1989 |
| JP | 2-25160 | | 2/1990 |
| JP | 08161923 | | 6/1996 |
| JP | 2000-308977 | | 11/2000 |

* cited by examiner

EXTENDABLE MULTI-TOOL INCLUDING INTERCHANGABLE LIGHT BULB CHANGER AND ACCESSORIES

RELATED APPLICATIONS

This Patent Application is a continuation of the co-pending U.S. patent application Ser. No. 13/945,642 filed on Jul. 18, 2013 and entitled "EXTENDABLE MULTI-TOOL INCLUDING INTERCHANGABLE LIGHT BULB CHANGER AND ACCESSORIES," which is a continuation of U.S. patent application Ser. No. 12/882,066 filed on Sep. 14, 2010 and entitled "EXTENDABLE MULTI-TOOL INCLUDING INTERCHANGABLE LIGHT BULB CHANGER AND ACCESSORIES," now issued as U.S. Pat. No. 8,516,925, which claims priority to U.S. Provisional Patent Application No. 61/243,448, filed on Sep. 17, 2009, and entitled "EXTENDABLE MULTI-TOOL INCLUDING INTERCHANGABLE LIGHT BULB CHANGER AND ACCESSORIES" under U.S.C. §119(e). This application incorporates the co-pending U.S. patent application Ser. No. 13/945,642 filed on Jul. 18, 2013 and entitled "EXTENDABLE MULTI-TOOL INCLUDING INTERCHANGABLE LIGHT BULB CHANGER AND ACCESSORIES," U.S. patent application Ser. No. 12/882,066 filed on Sep. 14, 2010 and entitled "EXTENDABLE MULTI-TOOL INCLUDING INTERCHANGABLE LIGHT BULB CHANGER AND ACCESSORIES," and the U.S. Provisional Patent Application No. 61/243,448, filed on Sep. 17, 2009, and entitled "EXTENDABLE MULTI-TOOL INCLUDING INTERCHANGABLE LIGHT BULB CHANGER AND ACCESSORIES" by their entirety.

FIELD OF THE INVENTION

The present invention relates to a remote access tool. More specifically, the present invention relates to a motorized device designed to remove and replace light bulbs and accomplish other tasks which require access to a variety of angles and heights that are otherwise inaccessible from ground level.

BACKGROUND OF THE INVENTION

Numerous remote access tools have been patented to alleviate the problems associated with accomplishing remote tasks. For example, tools have been patented in order to alleviate the problems associated with replacing light bulbs from remote locations. One such problem is accessibility. Overhead lights are purposefully positioned out of reach to minimize risks associated with heat burns and unintentional contact which could result in globe glass breakage. Another problem stems from the variety of angles from which bulbs must be extracted and replaced from these remote locations, such as from chandeliers and hanging light arrangements. Another problem is the adjustability of the handle to reach light bulbs at varying distances.

U.S. Pat. No. 1,514,814 to Allen, discloses an electric bulb holder which has bulb gripping arms that are pivotally connected to a slidable member which causes the bulb gripping arms to spread around the light bulb and then collapse to grip the light bulb. Once the user has a grip of the light bulb, she must rotate the whole bulb holder to screw or unscrew the light bulb. Further, the handle in this patent does not have a flexible arm for reaching light bulbs that are at an angle.

U.S. Pat. No. 2,983,541 to Maki discloses a device for removing or placing light bulbs in sockets. Specifically, the device taught by Maki consists of a fixed rod with a bendable arm for reaching light bulbs at different angles. The patent discloses using a helicoidal operating member inside the bendable arm which is bendable and rotatable. However, the device taught by Maki, by having a fixed rod, does not allow the user to adjust the rod to different heights. Also, the user must use an air bulb to create suction in an engaging cup to engage the light bulb. This is disadvantageous to the user, because the cup is not sufficiently thin such that it can effectively engage different sized light bulbs.

U.S. Pat. Nos. 1,202,432 and 1,201,506 to Rozelle et al., both disclose an adjustable device for placing and removing electric light bulbs. Specifically, the device taught in these patents utilizes a rod which has a pivoting section about a clamp screw for reaching light bulbs at different angles. However, the pivoting section is locked by tightening the clamp screw, which is burdensome on the user, because the user must use a screw driver, or some other external tool, to lock the pivoting shaft. Further, the rods taught in this patent are also adjustable to reach light bulbs at different heights, but the mechanism to lock the rods at a desired height is limiting. The mechanism to prevent the sliding of the rods consists of pins positioned along the rod which are configured to slide into a bayonet slot cut into the outer surface of the rod. Therefore, the user can only adjust the rod at certain heights, which is burdensome if the light bulb is at a height that does not correspond to any of the positions available on the rod.

Additionally, many of these same problems extend to other activities that need to take place in hard to reach areas, such as the difficulty that arises when trying to dust and clean the tops of shelves and lighting.

SUMMARY OF THE INVENTION

An extendable multi-tool comprises an extendable pole and a head unit selectively and detachably coupled together. The head unit comprises a grasping mechanism configured to engage a light bulb, a control switch and a rotation mechanism. The control switch is configured to cause the grasping mechanism to become secured to a light bulb, and to cause the rotation mechanism to automatically detect when a light bulb is secured to the grasping mechanism and then rotate the grasping unit and the secured light bulb in a first direction based on a position of the control switch. The tool further comprises an arm unit for positioning the grasping mechanism in a desired configuration to engage the light bulb, wherein the arm member is coupled to the grasping mechanism.

One aspect of the present application is directed to a multi-tool for selectively tightening and loosening a light bulb. The tool comprises a head unit configured to be coupled to a pole comprises a grasping mechanism a control switch and a rotation mechanism, wherein the rotation mechanism detects when a light bulb is fully screwed in and automatically stops rotating and releases the bulb from the grasping unit. In some embodiments, the pole is an extendable pole. The rotation mechanism automatically detects when a light bulb is secured to the grasping unit and rotates the grasping unit and thereby the light bulb in a first direction based on a position of the control switch. The control switch comprises three states wherein one state causes the rotation mechanism to rotate in the first direction and another state causes the rotation mechanism to rotate in the opposite direction. In some embodiments, the grasping mechanism comprises a suction cup wherein the suction cup is sufficiently thin such that it is able to effectively suction to any size light bulb. In some embodiments, the grasping mechanism further comprises a stabilizing ring configured to visually aid the user in centering the suction cup on a light bulb. The stabilizing ring is configured to fold backwards. The rotation mechanism comprises a motor and a sensor configured to sense when a light bulb is secured to the grasping mechanism. The sensor is further configured to sense when a light bulb secured to the grasping mechanism is fully screwed in or unscrewed from a light bulb socket. In some embodiments, the head unit further comprises a release button that is configured to release a light bulb that had been secured to the grasping mechanism. In some embodiments, the tool further comprises an arm unit comprises one or more elbow interfaces having an upper and lower arm coupled to each other wherein the upper and lower arms are able to rotate with respect to each other. The elbow interfaces further comprise a lock wherein the lock allows the user to selectively configure the angle between the upper and lower arms of the elbow interfaces. In some embodiments, the tool further comprises a number of first and second fasteners wherein the first fasteners comprise a release lever and a reception cavity and the second fasteners comprise a protruding member, wherein the protruding member is configured to automatically lock onto the cavities until the release levers are slid by the user. The first and second fasteners are used to selectively and detachably couple the extendable pole, the head unit and the arm unit together.

Another aspect of the present application is directed to a multi-tool for selectively tightening and loosening a light bulb. The tool comprises a sensor and a head unit configured to be coupled to a pole comprises a grasping mechanism and a control switch for controlling the grasping mechanism, wherein the sensor detects when a light bulb is fully screwed in and automatically stops the grasping mechanism from further rotating and releases the bulb from the grasping mechanism. In some embodiments, the pole is an extendable pole. In some embodiments, the grasping mechanism comprises a suction cup wherein the suction cup is sufficiently thin such that it is able to effectively suction to any size light bulb. The grasping mechanism further comprises a stabilizing ring configured to visually aid the user in centering the suction cup on a light bulb. The stabilizing ring is configured to fold backwards. In some embodiments, the head unit further comprises a release button that is configured to release a light bulb that had been secured to the grasping mechanism. In some embodiments, the tool further comprises a number of first and second fasteners wherein the first fasteners comprise a release lever and a reception cavity and the second fasteners comprise a protruding member, wherein the protruding member is configured to automatically lock onto the cavities until the release levers are slid by the user. The first and second fasteners are used to selectively and detachably couple the extendable pole and the head unit together.

Yet another aspect of the present application is directed to a multi-tool for remote access. The tool comprises a head unit configured to be coupled to a pole comprises a rotation mechanism, a detachable tool and a control switch for controlling the rotation mechanism, wherein the rotation mechanism rotates the detachable tool based on a position of the control switch. In some embodiments, the pole is an extendable pole. In some embodiments, the tool further comprises an arm unit comprises one or more elbow interfaces having an upper and lower arm coupled to each other wherein the upper and lower arms are able to rotate with respect to each other. The elbow interfaces further comprise a lock wherein the lock allows the user to selectively configure the angle between the upper and lower arms of the elbow interfaces. In some embodiments, the tool further comprises a number of first and second fasteners wherein the first fasteners comprise a release lever and a reception cavity and the second fasteners comprise a protruding member, wherein the protruding member is configured to automatically lock onto the cavities until the release levers are slid by the user. The first and second fasteners are used to selectively and detachably couple the detachable tool, the extendable pole, the head unit and the arm unit together.

Another aspect of the present application is directed to a method of using a multi-tool to tighten or loosen a light bulb. The method comprises detachably coupling a pole to a head unit wherein the head unit comprises a grasping mechanism, a control switch and a rotation mechanism, manipulating the control switch such that the rotation mechanism automatically detects when a light bulb is secured to the grasping unit and rotates the grasping unit and light bulb in a first direction based on a position of the control switch and securing a light bulb to the grasping unit. In some embodiments, the pole is an extendable pole. The control switch comprises three states wherein one state causes the rotation mechanism to rotate in the first direction and another state causes the rotation mechanism to rotate in the opposite direction. In some embodiments, the grasping mechanism comprises a suction cup wherein the suction cup is sufficiently thin such that it is able to effectively suction to any size light bulb. In some embodiments, the grasping mechanism further comprises a stabilizing ring configured to visually aid the user in centering the suction cup on a light bulb. The stabilizing ring is configured to fold backwards. In some embodiments, the method further comprises using the stabilizing ring to center the suction cup on a light bulb. In some embodiments, the rotation mechanism comprises a motor and a sensor configured to sense when a light bulb is secured to the grasping mechanism. The sensor is further configured to sense when a light bulb secured to the grasping mechanism is fully screwed in or unscrewed from a light bulb socket. In some embodiments, the head unit further comprises a release button that is configured to release a light bulb that had been secured to the grasping mechanism. In some embodiments, the method further comprises pressing the release button to release the light bulb that is secured to the grasping mechanism. In some embodiments, the tool further comprises an arm unit comprises one or more elbow interfaces having an upper and lower arm coupled to each other wherein the upper and lower arms are able to rotate with respect to each other. The elbow interfaces further comprise a lock wherein the lock allows the user to selectively configure the angle between the upper and lower arms of the elbow interfaces. In some embodiments, the tool further comprises a number of first and second fasteners wherein the first fasteners comprise a release lever and a reception cavity and the second fasteners comprise a protruding member, wherein the protruding member is configured to automatically lock onto the cavities until the release levers are slid by the user. In some embodiments, the method further comprises using the first and second fasteners to selectively detachably couple the extendable pole, the head unit and the arm unit together.

Another aspect of the present application is directed to a multi-tool for selectively tightening and loosening a light bulb. The tool comprises a sensor and a head unit configured to be coupled to a pole comprises a grasping mechanism, wherein the sensor detects when a light bulb is fully screwed in and automatically stops the grasping mechanism from further rotating and releases the bulb from the grasping mechanism. In some embodiments, the pole is an extendable pole. In some embodiments, the grasping mechanism comprises a suction cup wherein the suction cup is sufficiently thin such that it is able to effectively suction to any size light bulb. The grasping mechanism further comprises a stabilizing ring configured to visually aid the user in centering the suction cup on a light bulb. The stabilizing ring is configured to fold backwards. In some embodiments, the head unit further comprises a release button that is configured to release a light bulb that had been secured to the grasping mechanism. In some embodiments, the tool further comprises a number of first and second fasteners wherein the first fasteners comprise a release lever and a reception cavity and the second fasteners comprise a protruding member, wherein the protruding member is configured to automatically lock onto the cavities until the release levers are slid by the user. The first and second fasteners are used to selectively and detachably couple the extendable pole and the head unit together.

BRIEF DESCRIPTION OF THE DRAWINGS

FIG. 4A' illustrates a cross sectional view of a first embodiment of the head portion in accordance with some embodiments.

FIG. 4B' illustrates a cross sectional view of a second embodiment of the head portion in accordance with some embodiments.

FIG. 4C' illustrates a cross sectional view of a third embodiment of the head portion in accordance with some embodiments.

FIG. 4D' illustrates a cross sectional view of a fourth embodiment of the head portion in accordance with some embodiments.

DETAILED DESCRIPTION OF THE INVENTION

Figure 1:
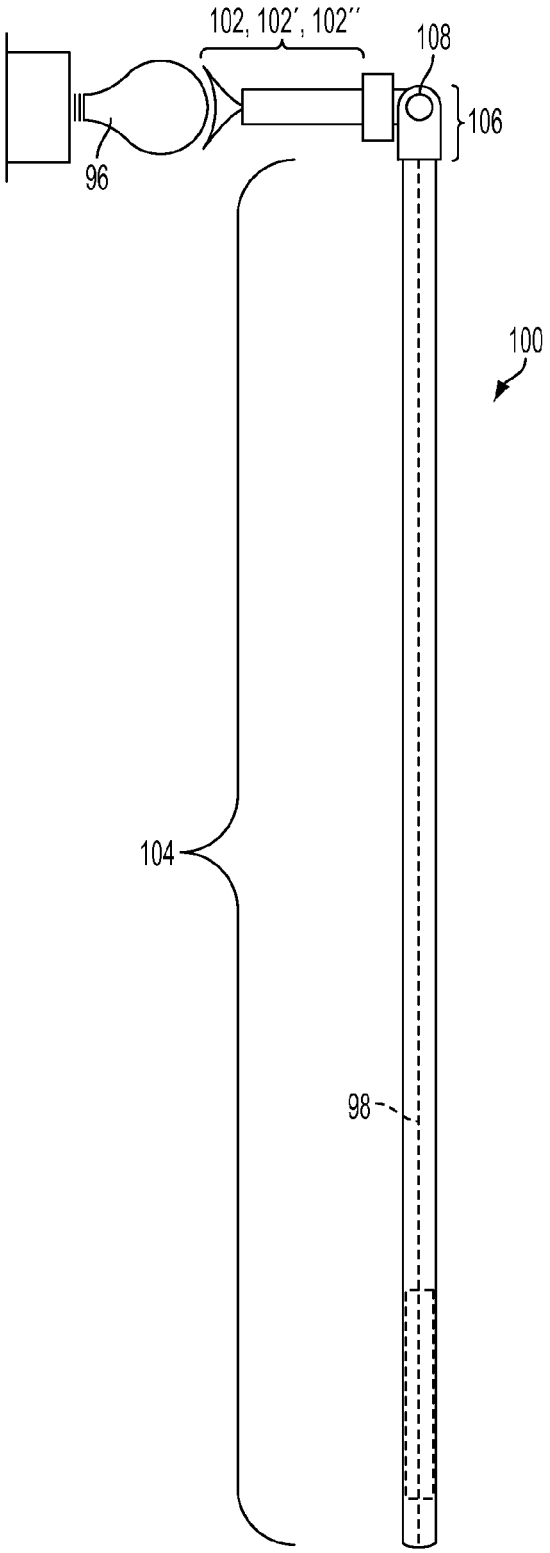
FIG. 1 illustrates a side view of one embodiment of the extendable multi-tool with pole, arm unit and head portion in accordance with some embodiments.

FIG. 1 illustrates a side view of an embodiment of the extendable multi-tool device 100 in accordance with some embodiments. In one embodiment, the extendable multi-tool 100 comprises a pole 104, a head portion 102, 102', 102", 102'", and an arm unit 106 having any number of elbow interfaces 108. Alternatively, the extendable multi-tool 100 comprises only the pole 104 and the head portion 102, 102', 102", 102'". The pole 104 is detachably coupled to the arm unit 106 which is detachably coupled to the head portion 102, 102', 102", 102'". Alternatively, any combination of the pole 104, arm unit 106 and head portion 102, 102', 102", 102'" are permanently coupled. Further alternatively, the pole 104 is directly attached to the head portion 102, 102', 102", 102'" either permanently or detachably.

Figure 2:
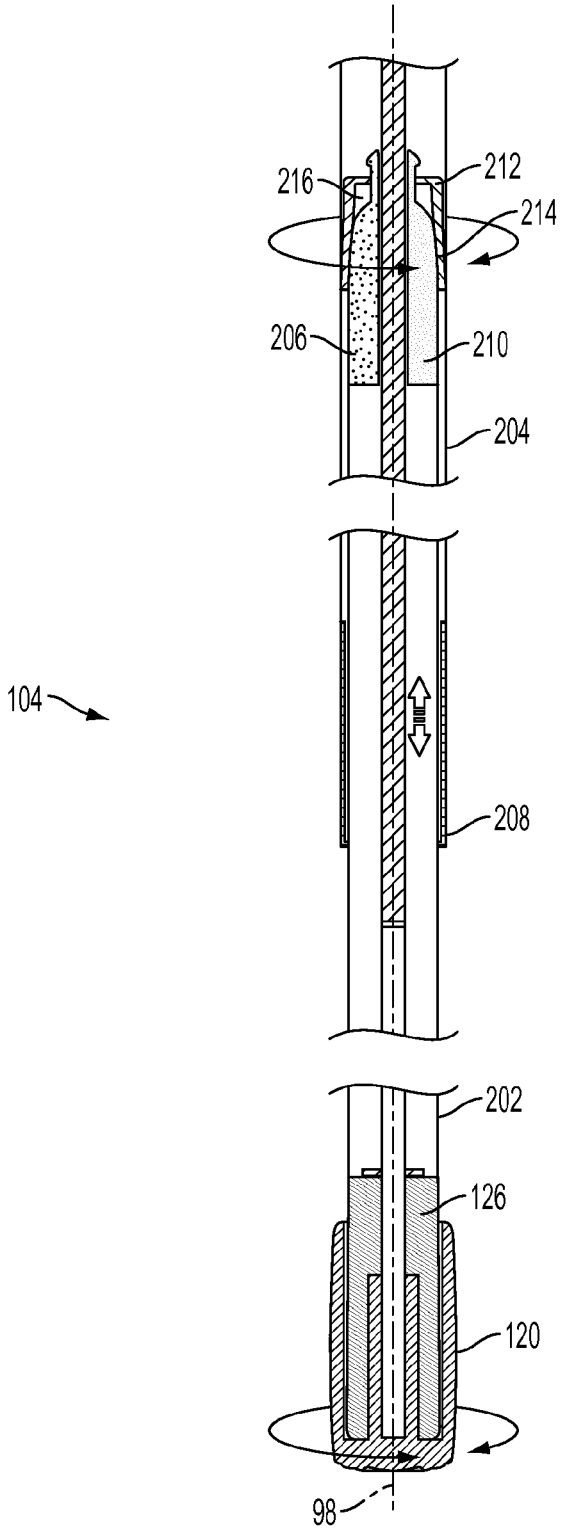
FIG. 2 illustrates a cross sectional view of the pole and pole locking mechanism of the extendable multi-tool in accordance with some embodiments.
Figure 6A:
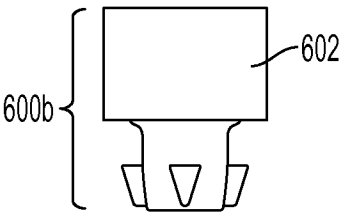
FIG. 6A illustrates a side view of a second fastener of the extendable multi-tool in accordance with some embodiments.
Figure 6C:
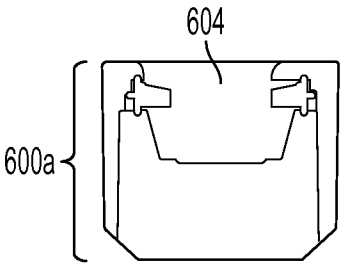
FIG. 6C illustrates a cross sectional view of a first fastener of the extendable multi-tool in accordance with some embodiments.
Figure 6B:
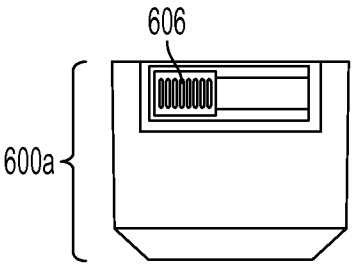
FIG. 6B illustrates a side view of a first fastener of the extendable multi-tool in accordance with some embodiments.
Figure 7:
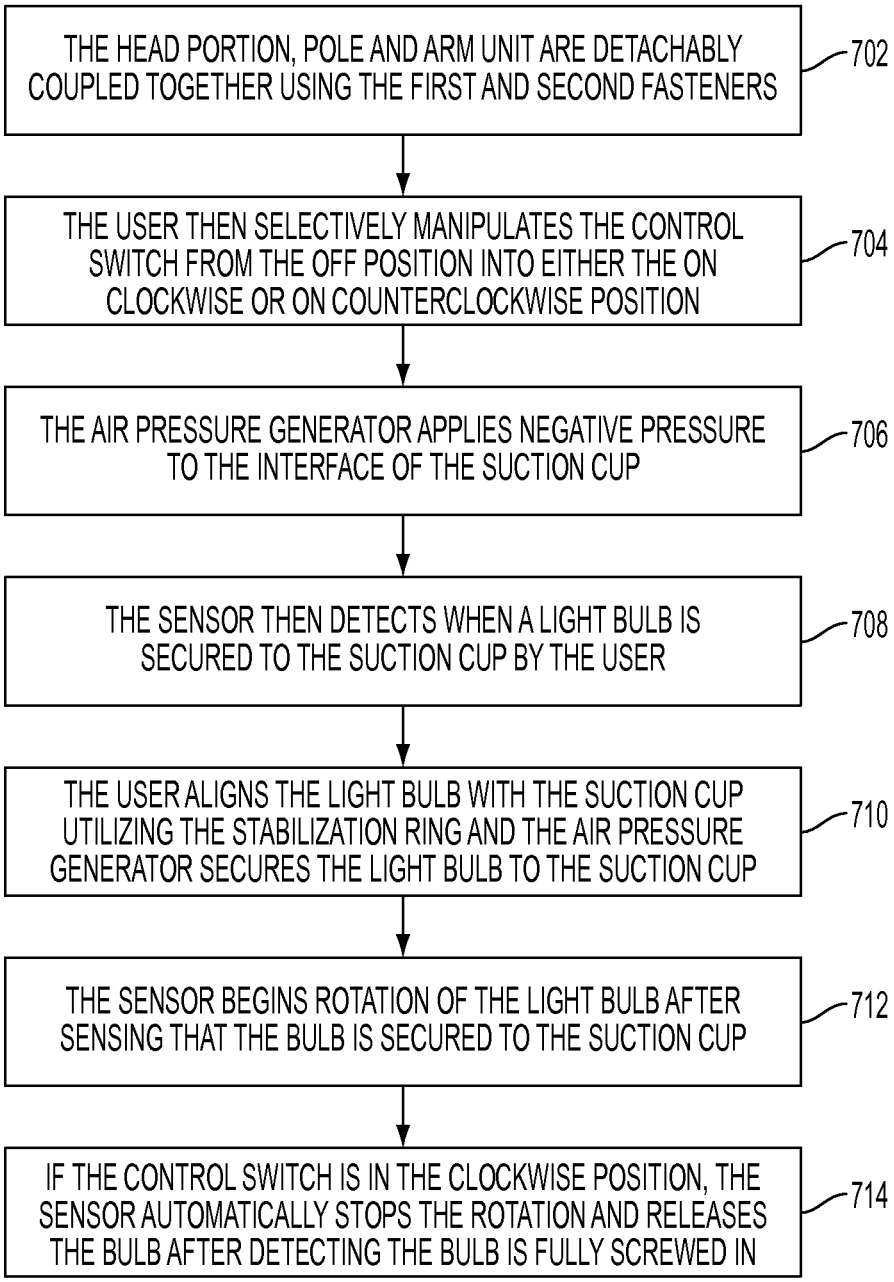
FIG. 7 illustrates a flow chart of a method of using the extendable multi-tool to tighten or loosen a light bulb in accordance with some embodiments.

As shown in FIG. 2, the pole 104 comprises an outer tube 202, and an inner tube 116 located within the outer tube 202 and slidable along a longitudinal axis 98 which passes through the center of both tubes. Both the inner and outer tubes 204, 202 have an upper and lower end and are positioned such that the upper ends of the tubes and the lower ends of the tubes correspond to each other respectively and are slidable with respect to each other along the same longitudinal axis 98. Alternatively, the pole 104 may comprise any number of tubes coupled within each other along the longitudinal axis 98, as appropriate, to allow the user to reach light bulbs at varying distances. The pole 104 further comprises a locking mechanism 206 and a lock notch 208. The lock notch 208 prevents the inner tube 204 from sliding out of the outer tube 202. As shown in FIG. 2, the lock notch 208 is located on the proximal end of the outer tube 202 and is positioned such that it does not allow the locking mechanism 206 to slide past the lock notch 208. The locking mechanism 206 comprises a tapered bushing 210 coupled to a lock sleeve 212 where the tapered bushing 210 has an end that is attached to the upper end of the inner tube 204. In some embodiments, the tapered bushing 210 is threaded and tapered at its outer surface 214, and the lock sleeve 212 is also threaded and tapered along its inner surface 216. Thus, the locking mechanism 206 is configured such that the threaded portion of the outer surface 214 of the tapered bushing 210 is registered with the threaded portion of the inner surface 216 of the lock sleeve 212. To lock the locking mechanism 206, the user turns the inner tube 204 to rotate the threaded portion 214 of the tapered bushing 210 upwards against the threaded portion 216 of the lock sleeve 212. The tapered shape of the tapered bushing 210 in its upward movement forces the lock sleeve 212 to expand about the longitudinal axis 98 and press against the inside of the outer tube 202. As a result, the inner tube 204 is prevented from sliding relative to any point on the outer tube 202 along the longitudinal axis 98. Alternatively, the pole 104 may be any other type of adjustable or non-adjustable pole known in the art. The pole 104 also comprises a first fastener 600A as shown in FIGS. 6B and 6C, wherein the first fastener 600A is coupled to the upper end of the pole 104 for detachably coupling the pole 104 to the head portion 102, 102', 102", 102'" or an elbow interface 108 via the protruding member 602 of a second fastener 600B (not shown). The first fastener 600A comprises a reception cavity 604 for receiving the protruding member 602 of the second fastener 600B via a "snap-fit" and a sliding lever 606 for disengaging the protruding member 602 from the reception cavity 604 of the first fastener 600A and thus allowing the second fastener 600B to be detached from the first fastener 600A. Accordingly, the first fastener 600A allows the pole 104 to be easily coupled to any second fastener 600B such that the second fastener 600B is automatically locked into place upon insertion, as well as allowing easy removal via a sliding lever 606 that quickly disengages the second fastener 600B from the pole 104. Alternatively, any coupling means are able to be coupled to the upper end of the pole 104 for removably attaching the pole 104 to the head portion 102, 102', 102", 102'" or an elbow interface 108. Accordingly, the pole 104 allows the user to change light bulbs and accomplish other tasks at any reasonable height that would normally be beyond their reach.

Figure 3B:
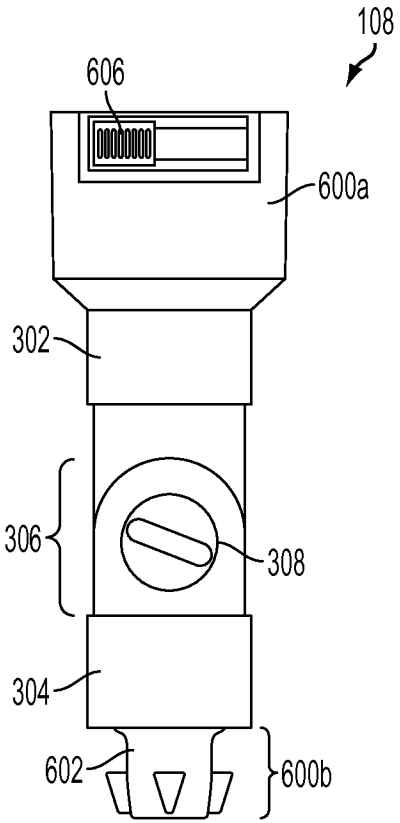
FIG. 3B illustrates a side view of the elbow interface of the extendable multi-tool in a straight position in accordance with some embodiments.
Figure 3A:
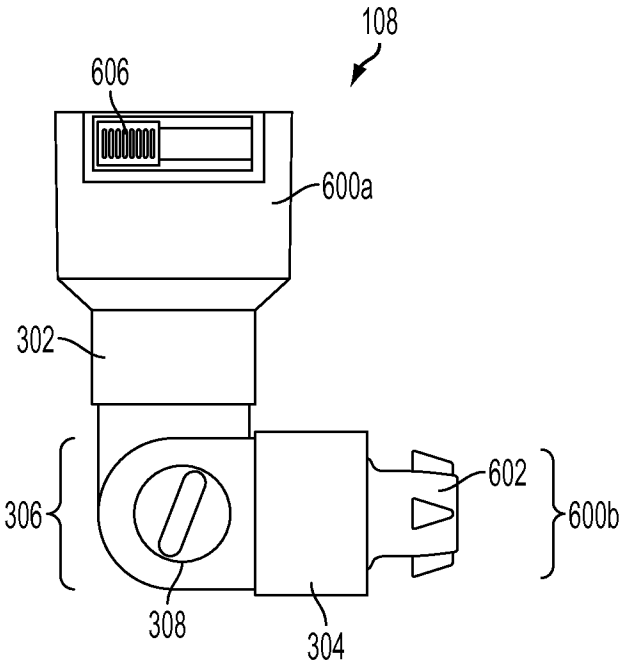
FIG. 3A illustrates a side view of the elbow interface of the extendable multi-tool in a bent position in accordance with some embodiments.

The arm unit 106, as shown in FIG. 1, comprises one or more elbow interfaces 108. As shown in FIGS. 3A and 3B, the elbow interfaces 108 comprise an upper arm 302, a lower arm 304, a first fastener 600A, a second fastener 600B, a joint 306 and a lock 308. The upper arm 302 is coupled to the lower arm 304 via the joint 306. Further, the upper arm 302 is coupled to the first fastener 600A and the lower arm 304 is coupled to the second fastener 600B. Additionally, the upper arm 302 and the lower arm 304 are adjustable with respect to one another via the joint 306 when the lock 308 is released. In contrast, the upper arm 302 and the lower arm 304 are not adjustable when the lock 308 is in the locked position. Accordingly, the user is able to position the arms 302 and 304 in the desired configuration while the lock 308 is released and then tighten the lock 308 to maintain the arms 302 and 304 in that configuration by setting the lock 308 to the locked position. In some embodiments, the upper and lower arms 302, 304, are able to move with respect to each other in 15 degree increments such that they range 180 degrees of movement. In another embodiment, any increment is possible and the range of movement is greater than 180 degrees. The lock 308 comprises rotatable loosening and tightening knobs. Alternatively, any other means for prohibiting and allowing the movement of the upper and lower arms 302, 304 with respect to one another are used, including but not limited to push/pull knobs, pins, screws and bolts. The first fastener 600A comprises a reception cavity 604 for receiving the protruding members 602 of the second fasteners 600B (not shown) via a "snap-fit" and a sliding lever 606 for disengaging the protruding members 602 from the reception cavity 604 of the first fastener 600A and thus allowing the second fasteners 600B to be detached from the first fastener 600A. Accordingly, the first fastener 600A allows the elbow interface 108 (and thereby the arm unit 106) to be easily coupled to any item comprises a second fastener type fastening means including any of the elbow interfaces 108, one or more attachments 500 (FIG. 5) or the head portion 102, 102', 102", 102'" (FIGS. 4A-D) such that the second fasteners 600B are automatically locked into place upon insertion. Further, the first fastener 600A allows for easy removal when the user slides the sliding lever 606 which quickly disengages any second fastener 600B from the elbow interface 108. Alternatively, any coupling means are able to be coupled to the upper arm 302 for removably attaching the elbow interface 108 to an attachment 500, head portion 102, 102', 102", 102'" or another elbow interface 108. The second fastener 600B comprises a protruding member 602"" that is configured to automatically snap-fit into the reception cavity 604 of the first fasteners 600A upon insertion of the protruding member 602 into the reception cavity 604. Accordingly, the second fastener 600B allows the user to detachably couple the elbow interface 108 (and thereby the arm unit 106) to the pole 104, another elbow interface 108 or any other device comprising a first fastener. Further, the protruding member 602 is configured to unlock/detach from the first fastener 600A when the user slides the release lever 606. Alternatively, any fastening means could be used to couple the elbow interface 108 to the pole 104 or another elbow interface 108, including screws, clamps and other fasteners well known in the art.

Figure 4A:
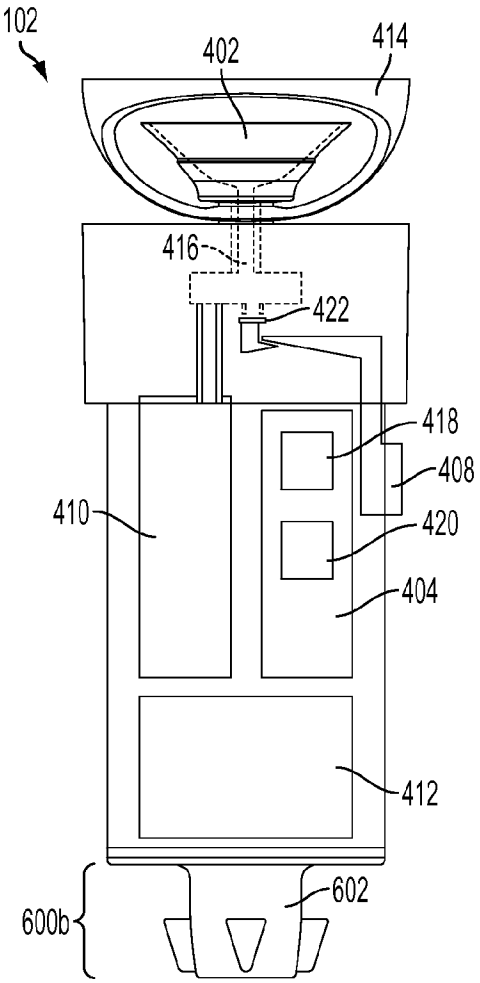
FIG. 4A illustrates a side view of a first embodiment of the head portion in accordance with some embodiments.
Figure 4A:
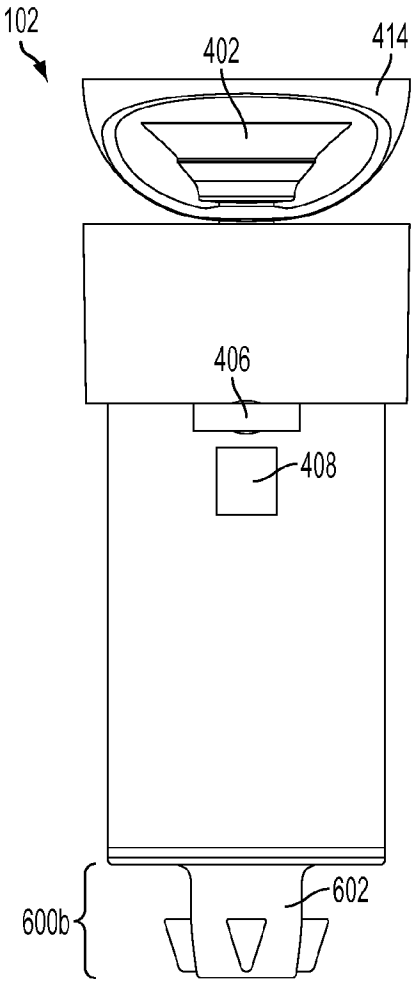

The head portion 102, as shown in FIGS. 4A and 4A', comprises a suction cup 402, a force generator 404, a sensor 420, a control switch 406, a bulb release button 408, an air pressure generator 410, a power source 412, a stabilizer ring 414, and a second fastener 600B. In some embodiments, the head portion 102 further comprises any number of first and second fasteners 600A, 600B for removably attaching one or more attachments 500 to the head portion 102. The suction cup 402 comprises an interface 416 for communication with the air pressure generator 410 and the light bulb 96. The pressure generator 410 is coupled to the suction cup 402 and the power source 412 such that when a particular voltage is applied to the pressure generator 410 from the power source 412 by the control switch 406, the pressure generator 410 applies negative air pressure on the interface 416 of the suction cup 402. In one exemplary aspect, the pressure generator 410 forms negative air pressure (a vacuum) and the negative pressure is provided to the interface 416, forcing the light bulb 96 against the suction cup 402. In this aspect, the interface 416 comprises an aperture 422 as illustrated; alternatively, the interface 416 includes a semi-permeable membrane or a porous structure. Though many pressure generators are contemplated in some embodiments, in the illustrated embodiment, the air pressure generator 410 is a suction generating device, such as a vacuum pump. Further, the pressure generator 410 is configured such that it automatically produces an appropriate amount of pressure to secure any light bulb to the suction cup 402. In addition, in some embodiments, the air pressure generator 410 is able to generate a positive pressure, e.g. through reversal of the vacuum system. Additionally, the body of the suction cup 402 is sufficiently thin such that it is able to be securely suctioned to any size light bulb by the pressure generator 410. Alternatively, the suction cup 402 may come in multiple sizes for being suctioned to specific light bulb sizes.

The force generator 404 comprises a step-motor 418 and is coupled to the suction cup 402, the sensor 420 and the power source 412 via the control switch 406. Alternatively, the motor 418 is any other appropriate type of motor known in the art, including but not limited to solenoid or direct voltage. When a particular voltage is applied to the force generator 404 from the power source 412 (e.g. when the control switch 406 is in state 2 or state 3 as described in detail below), the force generator 404 becomes active and will automatically cause the motor 418 to apply a rotational force on the suction cup 402. In some embodiments, once active, the force generator only applies a rotational force on the suction cup 402 if the sensor 420 detects that a light bulb has securely attached to the suction cup 402. Thus, because the suction cup 402 begins to rotate, and the light bulb 96 is secured to the cup 402, the light bulb 96 also begins to rotate. Accordingly, by applying a particular voltage to the force generator 404, the user is able to screw in the light bulb 96 with clockwise rotation and unscrew the light bulb 96 with counter-clockwise rotation. It should be noted that the suction cup 402 rotates clockwise or counter-clockwise independently of the configuration or position of the arm unit 106 and the pole 104. The direction of the rotational force supplied by the motor 418 depends on the state of the control switch 406.

The sensor 420 is coupled to the force generator 404 and the interface 416 of the suction cup 402. As described above, when a particular voltage is applied to the force generator 404 from the power source 412 and the force generator 404 becomes active, the sensor 420 also becomes active. Alternatively, the sensor 420 is always active. While active, the sensor 420 automatically stops the rotational force caused by the motor 418 if it senses a pre-determined sufficient rotational resistance (e.g. the light bulb 96 has been screwed in all the way). Further, if it senses the pre-determined sufficient rotational resistance, the sensor 420 automatically evacuates the vacuum of the interface 416 thereby releasing the light bulb or any other item that was secured to the suction cup 402 by the interface 416. In some embodiments, when active, the sensor 420 also starts the rotational force when it detects an item has been secured to the interface 416 of the suction cup 402. In some embodiments, the sensor 420 is pressure gauge and utilizes a snap-lever to stop the rotation and release the item secured to the suction cup 402. Alternatively, the sensor 420 is any other type of sensing device and utilizes any other means to stop the rotation and release the item secured to the suction cup 402.

The control switch 406 comprises three states ("state 1", "state 2" and "state 3") and is coupled to the air pressure generator 410, the force generator 404, and the power source 412. In some embodiments, the power source 412 is a DC source provided by one or more batteries. Alternatively, any power source is able to be used including an AC power source such as a cord for plugging into a power outlet. When in state 1, the control switch 406 is "off" and prevents power from the power source 412 from reaching the pressure generator 410 or the force generator 404. When in state 2 or 3, the control switch is "on clockwise" or "on counter-clockwise" respectively, and provides power to both the pressure generator 410 and the force generator 404 from the power source 412. Alternatively, any number of states could be used. This causes the pressure generator 410 to produce a vacuum on interface 416 for securing a light bulb 96 or any other item to the suction cup 402 as described above. As also described above, in some embodiments, it causes the sensor 420 to detect the when a light bulb or other item has attached to the suction cup 402 and if the light bulb has been screwed all the way in such that a sufficient rotational resistance is produced. In some embodiments, the control switch 406 has a fourth state ("state 4") wherein the fourth state causes power to be provided to the force generator 404 but not to the pressure generator 410 thereby causing the force generator 404 to rotate the head, but not causing the pressure generator to create a vacuum in the interface 416. Thus, the control switch 406 allows the user to control the operation of the head portion 102 such that it is selectively "off", "configured to automatically screw in a light bulb" or "to automatically unscrew a light bulb".

The bulb release button 408 is coupled to the interface 416 and is configured to eliminate the vacuum securing the light bulb to the suction cup 402 when pressed by the user. Specifically, bulb release button 408 covers an aperture 422 in the interface 416, such that when the button 408 is pressed by the user the aperture 422 in the interface 416 is uncovered and the vacuum pressure is released allowing the bulb 96 to be detached from the suction cup 402. Thus, the user is able to use the release button 408 to release a light bulb from the suction cup 402 without turning off the air pressure generator 410. Alternatively, any other means well known in the art could be used to detach the light bulb including physical removal by the user or turning off of the pressure generator 410.

The stabilizer ring 414 comprises a flexible hollow body with hemispherical shape and is coupled to the suction cup 402 such that the suction cup 402 is centered within the hemispherical body of the ring 414. Alternatively, the hollow body is inflexible. The stabilizer ring 414 is configured such that it visually aids the user in centering the suction cup 402 on larger light bulbs and such that it gives the user the perception of greater stability. Further, the ring 414 is configured such that it is able to be folded back to allow greater clearance on smaller fixtures and light bulbs. Alternatively, the ring 414 is removable to also allow greater clearance for use on smaller fixtures.

The second fastener 600B is coupled to the bottom of the head portion 102 and comprises a protruding member 602 that is configured to automatically snap-fit into the reception cavity 604 of the first fastener 600A upon insertion of the protruding member 602 into the reception cavity 604. Accordingly, the second fastener 600B allows the user to detachably couple the head portion 102 to the pole 104, elbow interface 108 or any other device comprising a first fastener 600A. Further, the protruding member 602 is configured to unlock/detach from the first fastener 600A when the user slides the release lever 606. Alternatively, any fastening means could be used to couple the head portion 102 to the pole 104 or an elbow interface 108, including screws, clamps and other fasteners well known in the art.

Figure 4B:
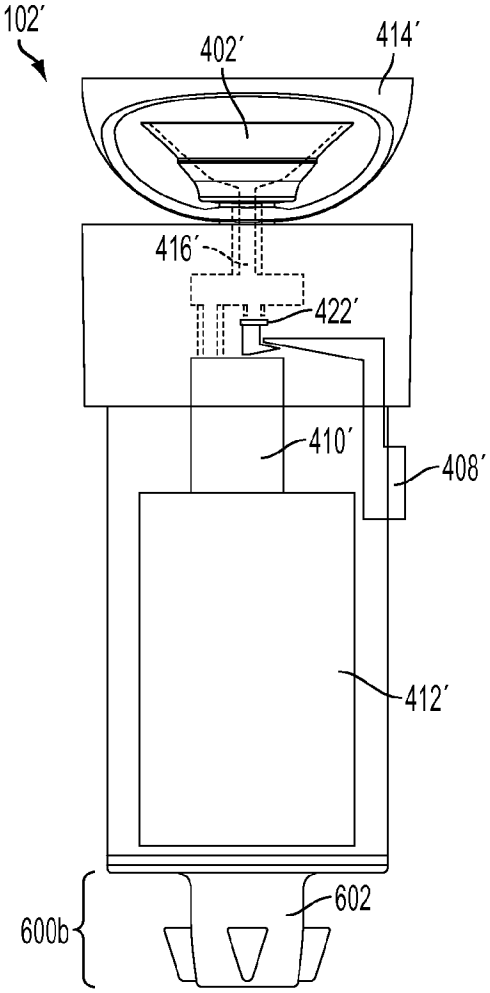
FIG. 4B illustrates a side view of a second embodiment of the head portion in accordance with some embodiments.
Figure 4B:
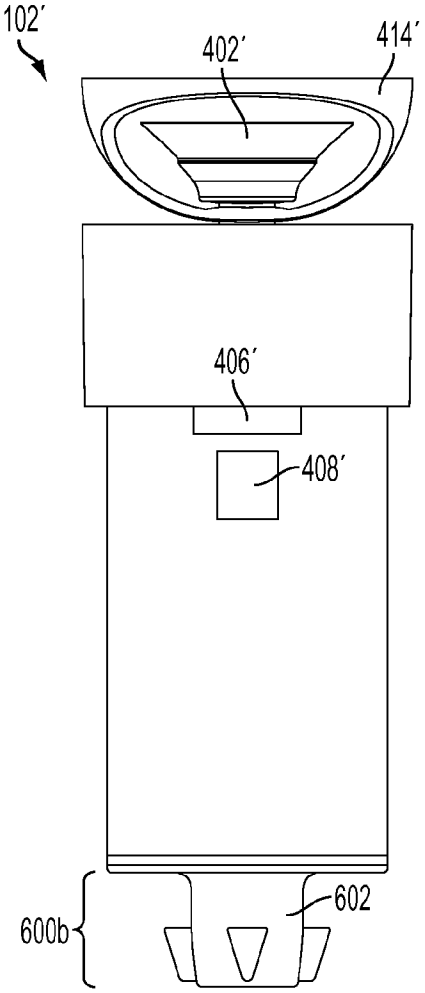

In an alternative embodiment of the head portion 102', as shown in FIGS. 4B and 4B', the head portion 102' comprises a suction cup 402', a control switch 406', a bulb release button 408', an air pressure generator 410', a power source 412', a stabilizer ring 414', a sensor 420', and a second fastener 600B. The suction cup 402' comprises an interface 416' for communication with the air pressure generator 410' and the light bulb 96. The pressure generator 410' is coupled to the suction cup 402' and the power source 412' such that when a particular voltage from the power source 412' is applied to the pressure generator 410' by the control switch 406', the pressure generator 410' applies negative air pressure on the interface 416' of the suction cup 402'. In one exemplary aspect, the pressure generator 410' forms negative air pressure (a vacuum) and the negative pressure is provided to the interface 416', forcing the light bulb 96 against the suction cup 402'. In this aspect, the interface 416' comprises an aperture 422' as illustrated; alternatively, the interface 416' includes a semipermeable membrane or a porous structure. Though many pressure generators are contemplated, in the illustrated embodiment, the air pressure generator 410' is a suction generating device, such as a vacuum pump. Further, the pressure generator 410' is configured such that it automatically produces an appropriate amount of pressure to secure any light bulb to the suction cup 402'. In addition, in some embodiments, the air pressure generator 410' is able to generate a positive pressure, e.g.

through reversal of the vacuum system. Additionally, the body of the suction cup 402' is sufficiently thin such that it is able to be securely suctioned to any size light bulb by the pressure generator 410'. Alternatively, the suction cup 402' may come in multiple sizes for being suctioned to specific light bulb sizes.

The control switch 406' comprises two states ("off" and "on") and is coupled to the air pressure generator 410' and the power source 412'. Alternatively, the control switch 406'comprises any number of states. In some embodiments, the power source 412' is a DC source provided by one or more batteries. Alternatively, any power source is able to be used including an AC power source such as a cord for plugging into a power outlet. When the control switch 406' is put into the "off" state, it prevents the voltage from the power source 412' from reaching the pressure generator 410'. When the power switch is "on" it provides power to the pressure generator 410' from the power source 412'. This causes the pressure generator 410' to produce a vacuum on interface 416' as described above for securing a light bulb 96 to the suction cup 402'. Thus, the control switch 406' allows the user to control the operation of the head portion 102' such that it is selectively "off" or "on".

The sensor 420' is coupled to the interface 416' of the suction cup 402'. When a particular voltage is applied to the pressure generator 410' from the power source 412' and the pressure generator 410' applies a vacuum to interface 416' as described above, the sensor 420' also becomes active. Alternatively, the sensor 420' is always active. While active, the sensor 420' automatically stops any rotational force applied to the bulb via the head portion 102' and the pole 104 by the user if it senses a pre-determined sufficient rotational resistance (e.g. the light bulb 96 has been screwed in all the way). Further, if it senses the pre-determined sufficient rotational resistance, the sensor 420 automatically evacuates the vacuum of the interface 416' thereby releasing the light bulb 96 or any other item that was secured to the suction cup 402' by the interface 416'. In some embodiments, the sensor 420' is a pressure gauge and utilizes a snap-lever to stop the rotation and release the item secured to the suction cup 402'. Alternatively, the sensor 420' is any other type of sensing device and utilizes any other means to stop the rotation and release the item secured to the suction cup 402'.

The bulb release button 408' is coupled to the interface 416' and is configured to eliminate the vacuum securing the light bulb to the suction cup 402' when pressed by the user. Specifically, bulb release button 408' covers an aperture 422' in the interface 416', such that when the button 408' is pressed by the user the aperture 422' in the interface 416' is uncovered and the vacuum pressure is released allowing the bulb 96 to be detached from the suction cup 402'. Thus, the user is able to use the release button 408' to release a light bulb from the suction cup 402' without turning off the air pressure generator 410'. Alternatively, any other means well known in the art could be used to detach the light bulb including physical removal by the user or manually turning off of the pressure generator 410'.

The stabilizer ring 414' comprises a flexible hollow body with hemispherical shape and is coupled to the suction cup 402' such that the suction cup 402' is centered within the hemispherical body of the ring 414'. Alternatively, the hollow body is inflexible. The stabilizer ring 414' is configured such that it visually aids the user in centering the suction cup 402' on larger light bulbs and such that it gives the user the perception of greater stability. Further, the ring 414' is configured such that it is able to be folded back to allow greater clearance on smaller fixtures and light bulbs. Alternatively, the ring 414' is removable to also allow greater clearance for use on smaller fixtures.

The second fastener 600B is coupled to the bottom of the head portion 102' and comprises a protruding member 602 that is configured to automatically snap-fit into the reception cavity 604 of the first fastener 600A upon insertion of the protruding member 602 into the reception cavity 604. Accordingly, the second fastener 600B allows the user to detachably couple the head portion 102' to the pole 104, elbow interface 108 or any other device comprising a first fastener 600A. Further, the protruding member 602 is configured to unlock/detach from the first fastener 600A when the user slides the release lever 606. Alternatively, any fastening means could be used to couple the head portion 102' to the pole 104 or an elbow interface 108, including screws, clamps and other fasteners well known in the art.

Figure 4C:
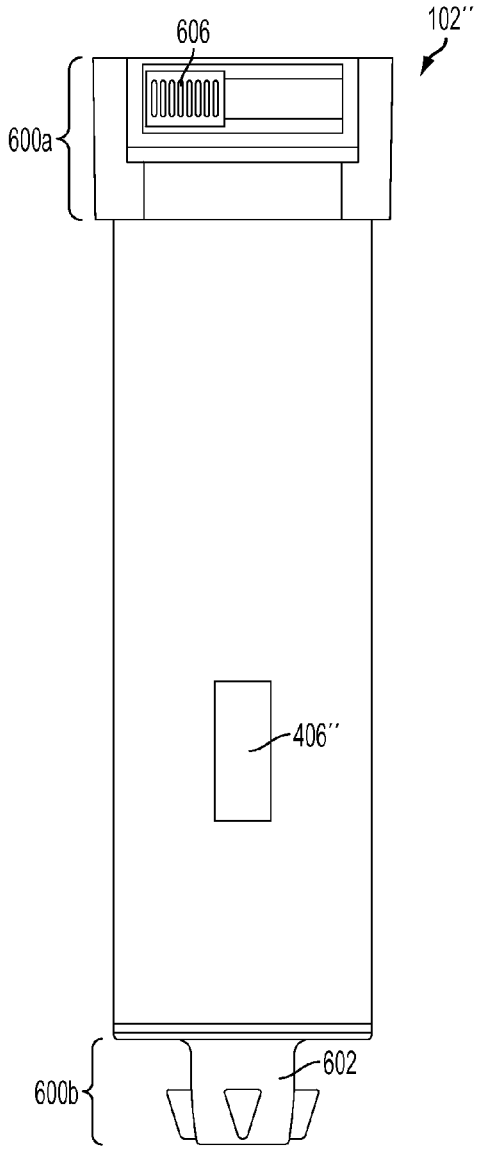
FIG. 4C illustrates a side view of a third embodiment of the head portion in accordance with some embodiments.
Figure 4C:
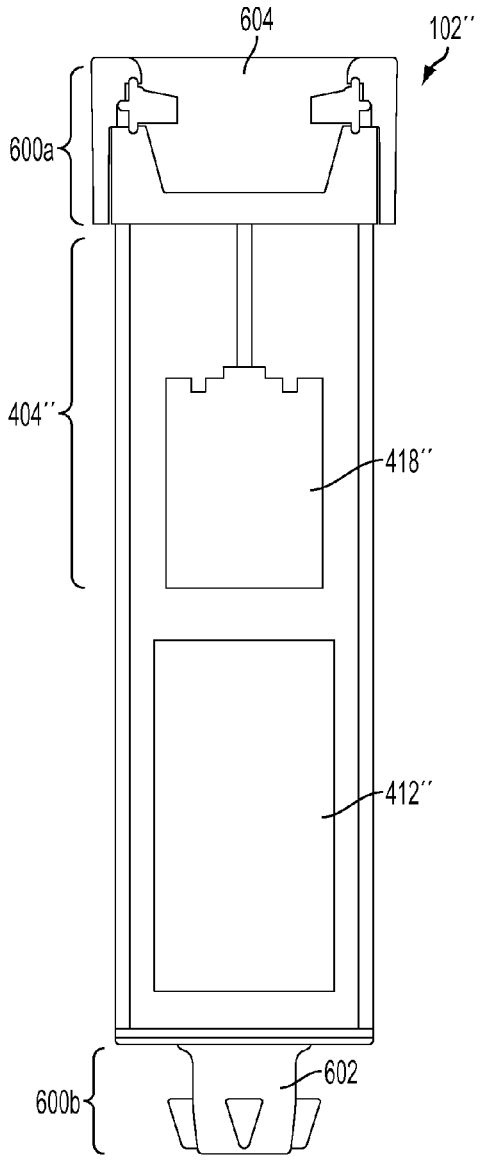

In yet another embodiment of the head portion 102", as shown in FIGS. 4C and 4C', the head portion 102" comprises a force generator 404", one or more attachments 500 (not shown), a control switch 406", a power source 412", a first fastener 600A and second fastener 600B. The force generator 404" is coupled to the first fastener 600A and the power source 412" via the control switch 406" and comprises a step-motor 418". Alternatively, the motor 418" is any other appropriate type of motor known in the art, including but not limited to solenoid or direct voltage. When a particular voltage is applied to the force generator 404" from the power source 412" (e.g. when the control switch 406" is turned "on" as described in detail below), the force generator 404" will automatically cause the motor 418" to apply a rotational force on the first fastener 600A such that the first fastener 600A and any of the one or more attachments 500 coupled to the first fastener 600A begin to rotate.

The control switch 406" comprises two states ("off" and "on") and is coupled to the force generator 404" and the power source 412". Alternatively, the control switch 406" comprises any number of states. In some embodiments, the power source 412" is a DC source provided by one or more batteries. Alternatively, any power source is able to be used including an AC power source such as a cord for plugging into a power outlet. When the control switch 406" is put into the "off" state, it prevents the voltage from the power source 412" from reaching the force generator 404". When the power switch is "on" it provides power to the force generator 404" from the power source 412". This causes the force generator 404" to apply rotational force on the first fastener 600A as described above. Thus, the control switch 406" allows the user to control the operation of the head portion 102" such that it is selectively "off" or "on".

The first fastener 600A is coupled to the force generator 404" at the top of the head portion 102" and comprises a reception cavity 604 for receiving the protruding members 602 of the second fasteners 600B (not shown) via a "snap-fit" and a sliding lever 606 for disengaging the protruding members 602 from the reception cavity 604 of the first fastener 600A and thus allowing the second fasteners 600B to be detached from the first fastener 600A. Accordingly, the first fastener 600A allows the head portion 102" to be easily coupled to any item comprising a second fastener type fastening means including any of the elbow interfaces 108 (FIG. 3), one or more attachments 500 (FIG. 5) or the head portion 102, 102' such that the second fasteners 600B are automatically locked into place upon insertion. Further, the first fastener 600A allows for easy removal when the user slides the sliding lever 606 which quickly disengages any second fastener 600B from the head portion 102". Alternatively, any coupling means is able to be coupled to the upper end of the head portion 102" for removably attaching the head portion 102" to an attachment 500, other head portion 102, 102', 102", 102'" or an elbow interface 108.

Figure 5:
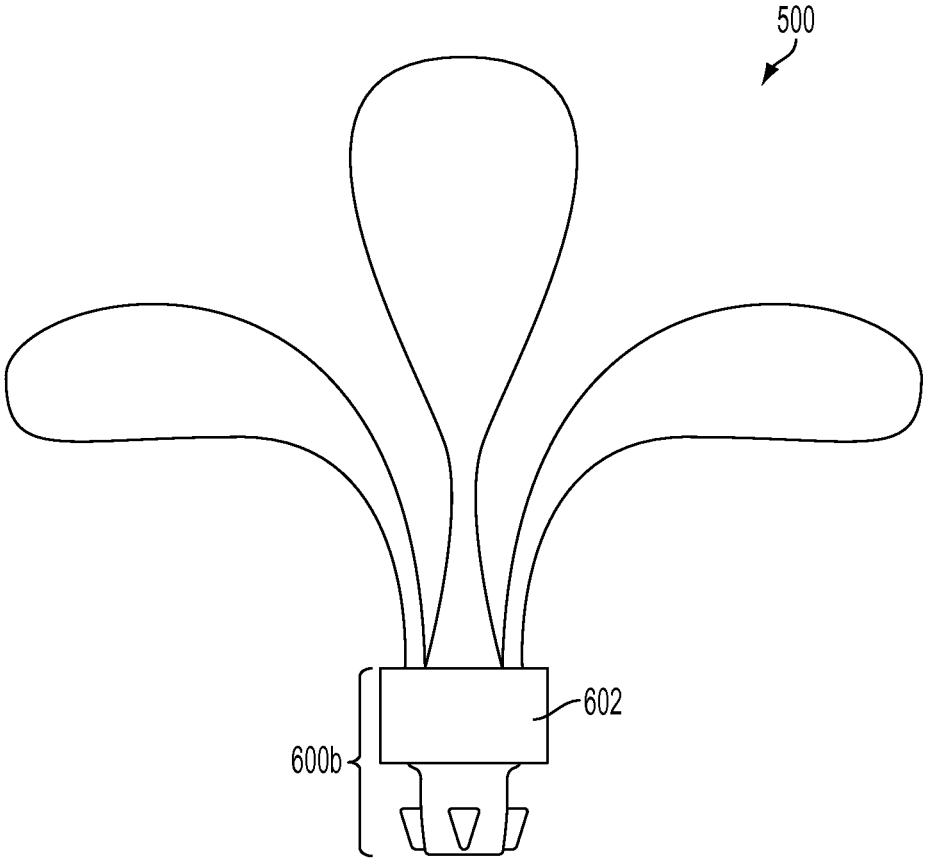
FIG. 5 illustrates a side view of an attachment to the extendable multi-tool changer in accordance with some embodiments.

The one or more attachments 500, as shown in FIG. 5, comprise a second fastener 600B and a tool 15 wherein the tool comprises a duster. Alternatively, the tool 15 is able to be any combination of dusters, cleaners, sweepers, fans, screwdrivers, or other tools. The second fastener 600B allows the user to removably attach the attachments 500 to the head portion 102" as described above, or any other items comprising a first fastener 600A including the pole 104. Alternatively, any coupling means is able to be used to removably attach the attachments 500 to the head portion 102" including screws, clamps and other fasteners well known in the art.

The second fastener 600B is coupled to the bottom of the head portion 102" and comprises a protruding member 602 that is configured to automatically snap-fit into the reception cavity 604 of the first fastener 600A upon insertion of the protruding member 602 into the reception cavity 604. Accordingly, the second fastener 600B allows the user to detachably couple the head portion 102" to the pole 104, elbow interface 108 or any other device comprising a first fastener 600A. Further, the protruding member 602 is configured to unlock/detach from the first fastener 600A when the user slides the release lever 606. Alternatively, any fastening means could be used to couple the head portion 102" to the pole 104 or an elbow interface 108, including screws, clamps and other fasteners well known in the art.

Figure 4D:
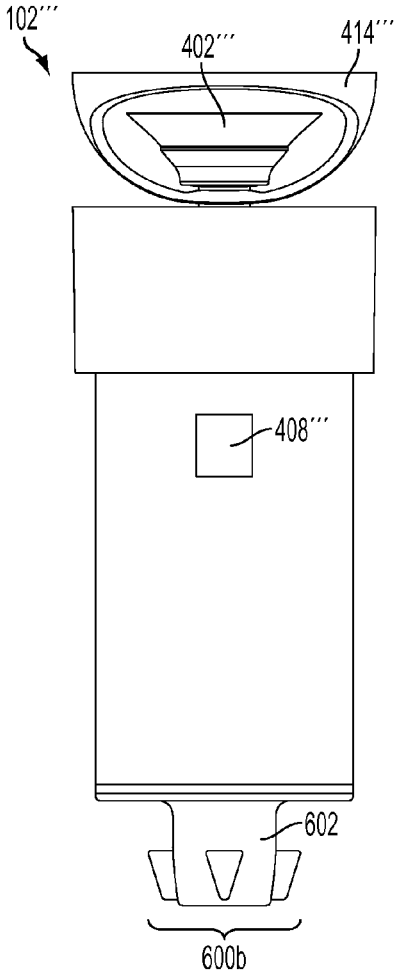
FIG. 4D illustrates a side view of a fourth embodiment of the head portion in accordance with some embodiments.
Figure 4D:
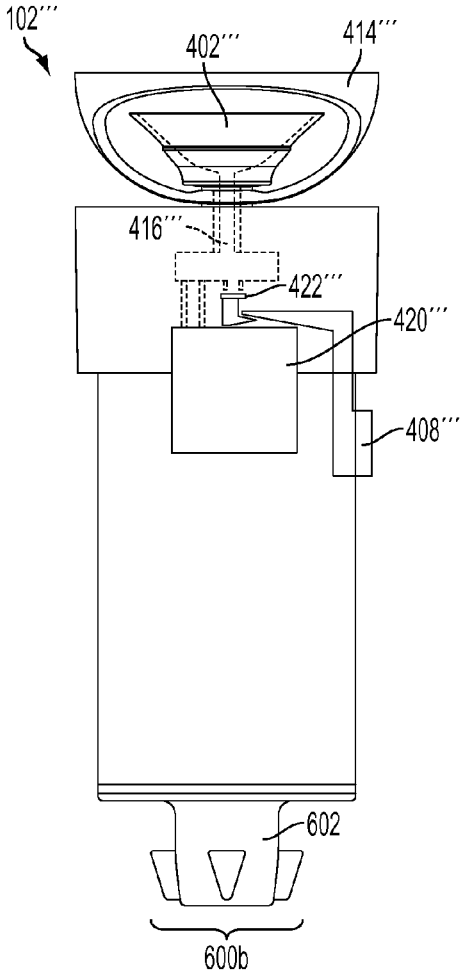

In yet another embodiment of the head portion 102'", as shown in FIGS. 4D and 4D', the head portion 102'" comprises a suction cup 402'", a bulb release button 408'", a stabilizer ring 414'", a sensor 420'", and a second fastener 600B. In this embodiment, the head portion 102'" does not include a vacuum pump. The suction cup 402'" comprises an interface 416'" for communication with the sensor 420'" and the light bulb 96. When pressed against a light bulb or other item, the suction cup 402'" applies negative air pressure on the interface 416'" and the surface of the light bulb thereby creating a vacuum. As a result, the light bulb 96 or other item is forced against and secured to the suction cup 402'". The interface 416'" comprises an aperture 422'" as illustrated; alternatively, the interface 416'" includes a semipermeable membrane or a porous structure. Additionally, the body of the suction cup 402'" is sufficiently thin such that it is able to be securely suctioned to any size light bulb by the user. Alternatively, the suction cup 402'" may come in multiple sizes for being suctioned to specific light bulb sizes.

The sensor 420'" is coupled to the interface 416'" of the suction cup 402'". When the suction cup 402'" and thereby the light bulb 96 is subjected to a rotational force via the head portion 102'" and the pole 104 by the user, the sensor 420'" automatically stops the rotational force if it senses a pre-determined sufficient rotational resistance (e.g. the light bulb 96 has been screwed in all the way). Further, if it senses the pre-determined sufficient rotational resistance, the sensor 420'" automatically evacuates the vacuum of the interface 416'" and the surface of the bulb 96 or other item, thereby releasing the light bulb 96 or any other item that was secured to the suction cup 402'" by the interface 416'". In some embodiments, the sensor 420'" is pressure gauge and utilizes a snap-lever to stop the rotation and release the item secured to the suction cup 402'". Alternatively, the sensor 420'" is any other type of sensing device and utilizes any other means to stop the rotation and release the item secured to the suction cup 402'".

The bulb release button 408'" is coupled to the interface 416'" and is configured to eliminate the vacuum securing the light bulb 96 to the suction cup 402'" when pressed by the user. Specifically, the bulb release button 408'" covers an aperture 422'" in the interface 416'", such that when the button 408'" is pressed by the user the aperture 422'" in the interface 416'" is uncovered and the vacuum pressure is released allowing the bulb 96 to be detached from the suction cup 402'". Thus, the user is able to use the release button 408'" to release a light bulb from the suction cup 402'". Alternatively, any other means well known in the art could be used to detach the light bulb including physical removal by the user.

The stabilizer ring 414'" comprises a flexible hollow body with hemispherical shape and is coupled to the suction cup 402'" such that the suction cup 402'" is centered within the hemispherical body of the ring 414'". Alternatively, the hollow body is inflexible. The stabilizer ring 414'" is configured such that it visually aids the user in centering the suction cup 402'" on larger light bulbs and such that it gives the user the perception of greater stability. Further, the ring 414'" is configured such that it is able to be folded back to allow greater clearance on smaller fixtures and light bulbs. Alternatively, the ring 414'" is removable to also allow greater clearance for use on smaller fixtures.

The second fastener 600B is coupled to the bottom of the head portion 102'" and comprises a protruding member 602 that is configured to automatically snap-fit into the reception cavity 604 of the first fastener 600A upon insertion of the protruding member 602 into the reception cavity 604. Accordingly, the second fastener 600B allows the user to detachably couple the head portion 102'" to the pole 104, elbow interface 108 or any other device comprising a first fastener 600A. Further, the protruding member 602 is configured to unlock/detach from the first fastener 600A when the user slides the release lever 606. Alternatively, any fastening means could be used to couple the head portion 102'" to the pole 104 or an elbow interface 108, including screws, clamps and other fasteners well known in the art.

The operation of the extendable multi-tool will now be discussed in conjunction with the flow charts illustrated in FIGS. 7, 8, 9 and 10. In operation, as described in FIG. 7, the user detachably couples the head portion 102, the pole 104, and the arm unit 106 using the first and second fasteners 600A, 600B at the step 702. Alternatively, only the head portion 102 and the pole 104 are detachably coupled using the first and second fasteners 600A, 600B. Alternatively, any suitable fastening means are used. In some embodiments, the user then adjusts the positioning of the upper and lower arms 302, 304 of the elbow interfaces 108 of the arm unit 106 until the desired configuration is established. The user then selectively manipulates the control switch 406 from the off position into either the on clockwise or on counterclockwise position at the step 704. The air pressure generator 410 then applies negative pressure to the interface 416 at the step 706. The sensor 420 then begins sensing for a light bulb 96 to be secured to the suction cup 402 by the user at the step 708. The user then aligns the bulb 96 with the suction cup 402 via the stabilization ring 414 and the pressure generator 410 secures the bulb 96 to the suction cup 402 at the step 710. Alternatively, the user folds back the stabilization ring 414 to allow easier access to the bulb 96 by the suction cup 402. The sensor 420 then senses the secure bulb 96 and begins to rotate the bulb 96 either clockwise or counterclockwise depending on the position of the control switch 406 at the step 712. If the control switch 406 was in the clockwise position, the sensor 420 then automatically stops the rotation of the bulb 96 and releases the bulb from the suction cup 402 after detecting that the bulb 96 is fully screwed in at the step 714. Alternatively, if the control switch 406 was in the counterclockwise position, the user then presses the bulb release button 408 and thereby releases the bulb 96 from the suction cup 402. Alternatively, the user turns the control switch 406 to the off position and thereby removes the bulb 96.

Figure 8:
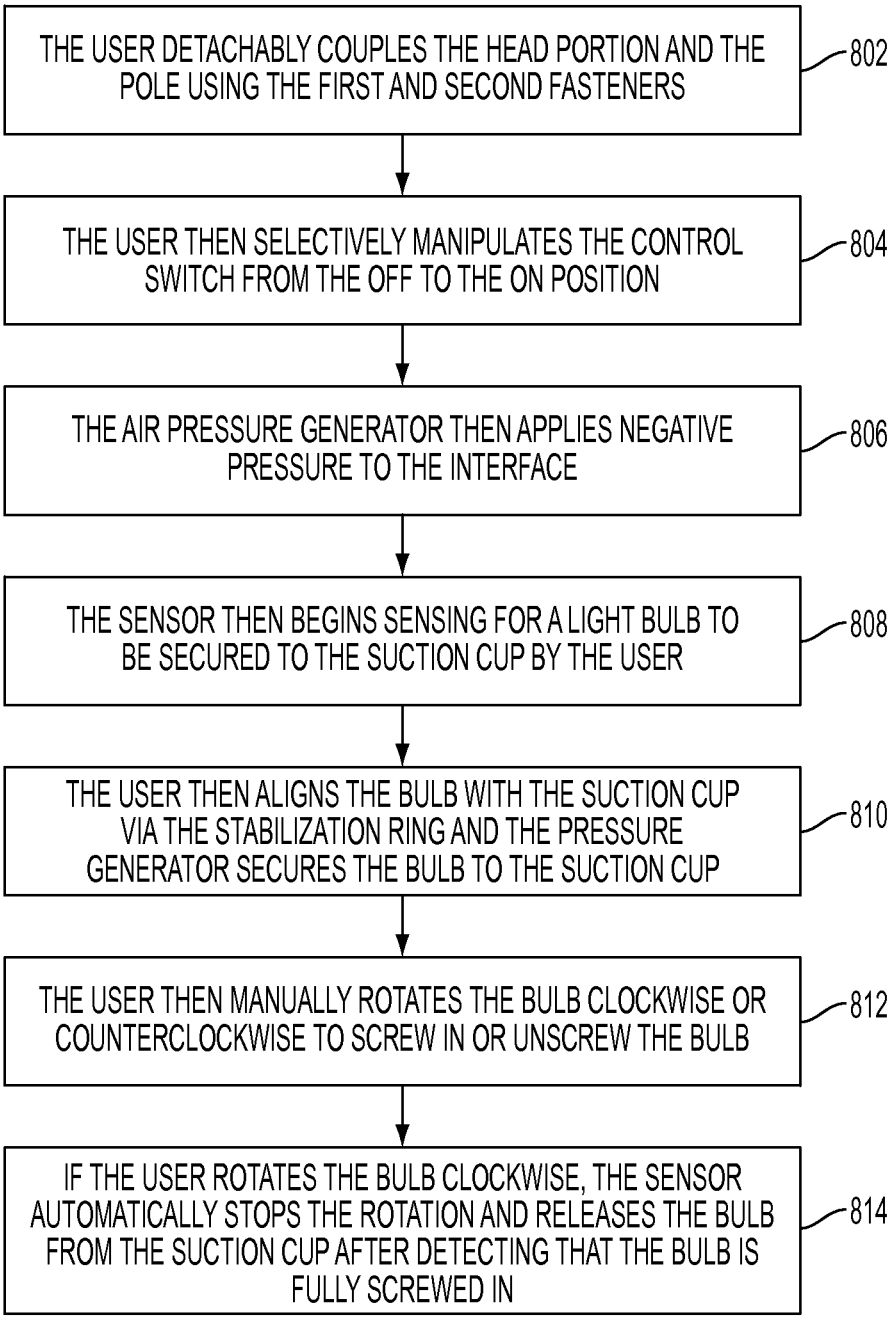
FIG. 8 illustrates a flow chart of a method of using the extendable multi-tool to tighten or loosen a light bulb in accordance with some embodiments.

In operation in another embodiment, as described in FIG. 8, the user detachably couples the head portion 102' and the pole 104 using the first and second fasteners 600A, 600B at the step 802. Alternatively, any suitable fastening means are used. The user then selectively manipulates the control switch 406' from the off to the on position at the step 804. The air pressure generator 410' then applies negative pressure to the interface 416' at the step 806. The sensor 420' then begins sensing for a light bulb 96 to be secured to the suction cup 402' by the user at the step 808. The user then aligns the bulb 96 with the suction cup 402' via the stabilization ring 414' and the pressure generator 410' secures the bulb 96 to the suction cup 402' at the step 810. Alternatively, the user folds back the stabilization ring 414' to allow easier access to the bulb 96 by the suction cup 402'. The user then manually rotates the bulb 96 clockwise or counterclockwise to screw in or unscrew the bulb at the step 812. If the user rotates the bulb 96 clockwise, the sensor 420' automatically stops the rotation and releases the bulb 96 from the suction cup 402' after detecting that the bulb 96 is fully screwed in at the step 814. Alternatively, if the user rotates the bulb 96 counterclockwise to unscrew it, the user then presses the bulb release button 408' and thereby releases the bulb 96 from the suction cup 402'. Alternatively, the user turns the control switch 406' to the off position and thereby removes the bulb 96.

Figure 9:
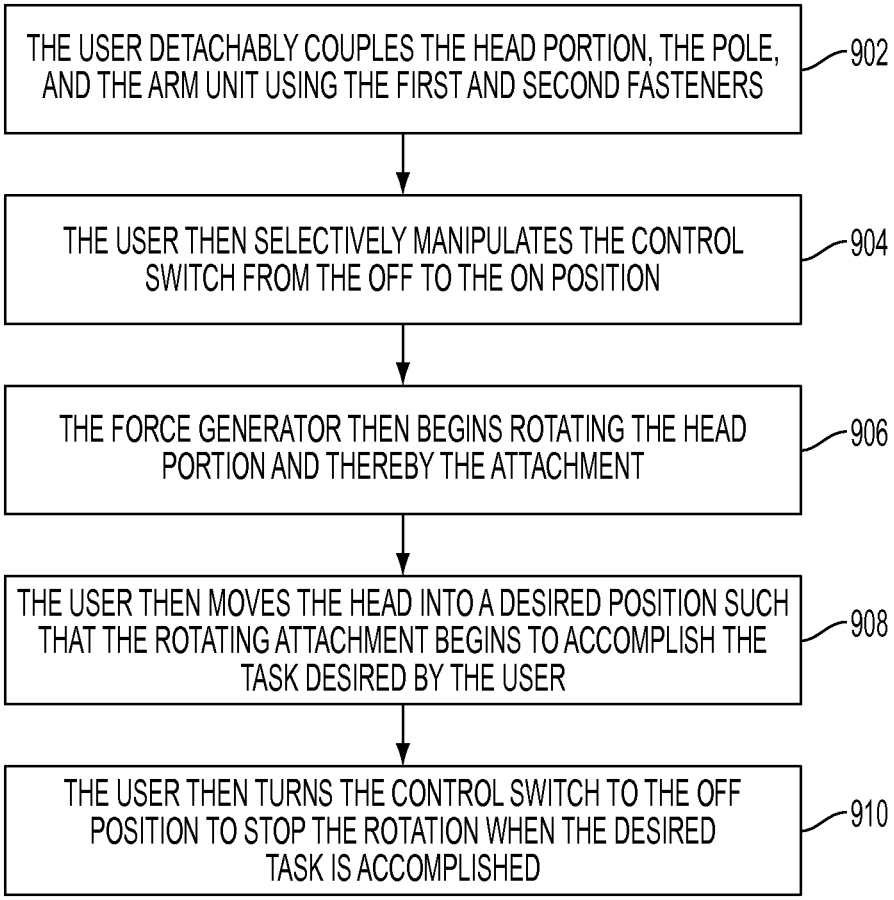
FIG. 9 illustrates a flow chart of a method of using the extendable multi-tool to accomplish a remote task in accordance with some embodiments.

In operation in another embodiment, as described in FIG. 9, the user detachably couples the head portion 102", the pole 104, and the arm unit 106 using the first and second fasteners 600A, 600B at the step 902. Alternatively, only the head portion 102" and the pole 104 are detachably coupled using the first and second fasteners 600A, 600B. Alternatively, any suitable fastening means are used. In some embodiments, the user then adjusts the positioning of the upper and lower arms 302, 304 of the elbow interfaces 108 of the arm unit 106 until the desired configuration is established. The user then selectively manipulates the control switch 406" from the off to the on position at the step 904. The force generator 410" then begins rotating the head portion 102" and thereby the attachment 500 at the step 906. The user then moves the head 102" into a desired position such that the rotating attachment 500 begins to accomplish the task desired by the user at the step 908. The user then turns the control switch 406" to the off position to stop the rotation when the desired task is accomplished at the step 910.

Figure 10:
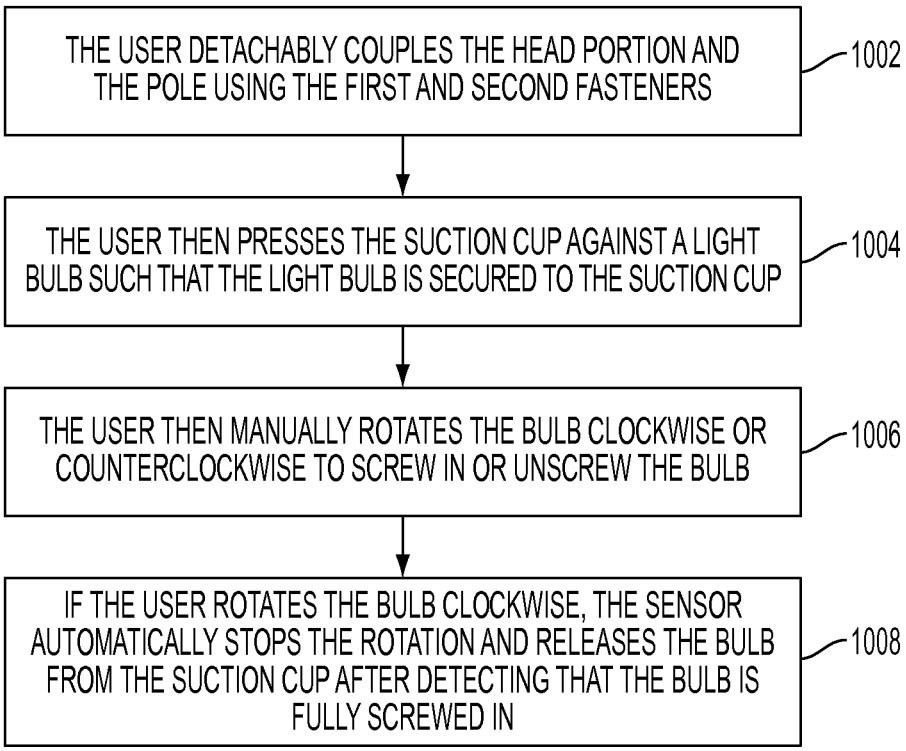
FIG. 10 illustrates a flow chart of a method of using the extendable multi-tool to tighten or loosen a light bulb in accordance with some embodiments.

In operation in yet another embodiment, as described in FIG. 10, the user detachably couples the head portion 102'" and the pole 104 using the first and second fasteners 600A, 600B at the step 1002. Alternatively, any suitable fastening means are used. The user then presses the suction cup 402'" against a light bulb such that the light bulb is secured to the suction cup 402" at the step 1004. In some embodiments, the user then aligns the bulb 96 with the suction cup 402'" via the stabilization ring 414'" for securing the bulb 96 to the suction cup 402'". Alternatively, the user folds back the stabilization ring 414'" to allow easier access to the bulb 96 by the suction cup 402'". The user then manually rotates the bulb 96 clockwise or counterclockwise to screw in or unscrew the bulb at the step 1006. If the user rotates the bulb 96 clockwise, the sensor 420'" automatically stops the rotation and releases the bulb 96 from the suction cup 402'" after detecting that the bulb 96 is fully screwed in at the step 1008. Alternatively, if the user rotates the bulb 96 counterclockwise to unscrew it, the user then presses the bulb release button 408'" and thereby releases the bulb 96 from the suction cup 402'".

As described above, the extendable multi-tool provides a remote access tool that allows the user to remotely change a light bulb and perform other activities. Specifically, it automatically senses when a bulb is attached and then begins rotation of the bulb. Also, it detects when a light bulb has been fully screwed in and automatically stops the rotation and releases the bulb. Further, it provides a sufficiently thin suction cup such that it is able to safely secure any size bulb without need to switch to different cups. It provides a bulb release button that allows the bulbs to be safely detached from the suction cup without the need to turn off the control switch. Also, it provides a stabilizer ring that visually aids the user in centering the suction cup on larger bulbs, as well as giving the perception of greater stability and being able to be folded back to allow greater clearance on small fixtures and bulbs. Finally, it provides a universal fastening system using the first and second fasteners that allows the user to automatically lock the items together when the protruding member is inserted into the cavity while also permitting an easy release method with the sliding of the release lever. Accordingly, the extendable multi-tool provides a versatile extendable multi-tool that allows the user to easily accomplish tasks such as changing light bulbs and dusting or cleaning in hard to reach areas.

Some embodiments have been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention.

We claim:

1. A tool for inserting a light bulb comprising:

a. a motorized head unit for turning the light bulb; and b. a sensor to sense when the light bulb is fully screwed into a socket.

2. The tool according to claim 1 wherein the tool further comprises an arm unit comprising one or more elbow interfaces having an upper and lower arm coupled to each other wherein the upper and lower arms are able to rotate with respect to each other.

3. The tool according to claim 2 wherein the elbow interfaces further comprise a lock wherein the lock allows the user to selectively configure the angle between the upper and lower arms of the elbow interfaces.

4. The tool according to claim 2 wherein the tool further comprises a number of first and second fasteners wherein the first fasteners comprise a release lever and a reception cavity and the second fasteners comprise a protruding member, wherein the protruding members is configured to automatically lock onto the cavities until the release levers are slid by the user.

5. The tool according to claim 4 wherein the first and second fasteners are used to selectively detachably couple an extendable pole, the head unit and the arm unit together.

6. The tool according to claim 1 wherein the head unit comprises a grasping mechanism for grasping the light bulb.

7. The tool according to claim 6 wherein the grasping mechanism comprises a suction cup wherein the suction cup is sufficiently thin such that it is able to effectively suction to any size light bulb.

8. The tool according to claim 6 wherein the grasping mechanism further comprises a stabilizing ring configured to visually aid the user in centering the suction cup on a light bulb.

9. The tool according to claim 8 wherein the stabilizing ring is configured to fold backwards.

10. The tool according to claim 1 wherein the head unit detects that a light bulb is coupled to the head and rotates the light bulb in a first direction based on a position of a control switch.

11. The tool according to claim 10 wherein the control switch comprises three states wherein one state causes the light bulb to rotate in the first direction and another state causes the light bulb to rotate in the opposite direction.

12. The tool according to claim 1 wherein the head unit further comprises a release button that is configured to release a light bulb that had been secured to the grasping mechanism.

13. A motorized head unit for inserting a light bulb comprising:

a. a force generator for rotating a light bulb held by the head unit; and b. a sensor for sensing that the light bulb is fully screwed into a socket.

14. The head unit according to claim 13 wherein the head unit detects that a light bulb is coupled to the head and rotates the light bulb in a first direction based on a position of a control switch.

15. The head unit according to claim 13 wherein the head unit is configured to couple to an extendable pole.

16. A method of inserting a light bulb into a socket using a motorized tool comprising:

a. rotating the light bulb into the socket;

b. sensing that the light bulb has been fully screwed into the socket; and c. stopping rotation of the motorized tool when it is sensed that the light bulb has been fully screwed into the socket.

17. The method according to claim 16 wherein sensing that the light bulb has been screwed in all of the way comprises sensing a pre-determined rotational resistance.

18. The method according to claim 17 wherein the light bulb is released from the motorized tool when the pre-determined rotational resistance is sensed.

19. The method according to claim 16 wherein the light bulb is rotated when it is sensed that the motorized tool has grasped the light bulb.

* * * * *